US010865582B2

(12) United States Patent
Roberts et al.

(10) Patent No.: US 10,865,582 B2
(45) Date of Patent: Dec. 15, 2020

(54) FLASHING SYSTEMS AND METHODS FOR MODULAR BLAST, BALLISTIC, AND FORCED ENTRY RESISTANT SHELTERS

(71) Applicant: United States of America as Represented by The Secretary of The Army, Alexandria, VA (US)

(72) Inventors: Justin M Roberts, Florence, MS (US); Craig R Ackerman, Gainesville, VA (US)

(73) Assignee: UNITED STATES OF AMERICA AS REPRESENTED BY THE SECRETARY OF THE ARMY, Alexandria, VA (US)

( * ) Notice: Subject to any disclaimer, the term of this patent is extended or adjusted under 35 U.S.C. 154(b) by 0 days.

(21) Appl. No.: 16/219,858

(22) Filed: Dec. 13, 2018

(65) Prior Publication Data

US 2020/0190841 A1 Jun. 18, 2020

(51) Int. Cl.
*E04H 9/04* (2006.01)
*E04B 1/348* (2006.01)
*E04F 19/02* (2006.01)

(52) U.S. Cl.
CPC ..... *E04H 9/04* (2013.01); *E04B 1/348* (2013.01); *E04F 19/02* (2013.01)

(58) Field of Classification Search
CPC .... E04H 9/04; E04H 9/06; E04H 9/10; E04H 9/14; E04F 19/02; E04B 1/348
See application file for complete search history.

(56) References Cited

U.S. PATENT DOCUMENTS 5,983,578 A * 11/1999 Huttie ..... E04H 9/06 109/1 S
6,490,834 B1 * 12/2002 Dagher ..... E04H 9/14 52/506.01
7,685,921 B2 * 3/2010 Dagher ..... F41H 5/013 109/80
8,429,857 B2 * 4/2013 Melrose ..... F41H 5/013 52/169.6

(Continued)

FOREIGN PATENT DOCUMENTS

GB 2478373 A * 9/2011 ..... E04B 1/6813

*Primary Examiner* — Rodney Mintz
(74) *Attorney, Agent, or Firm* — Brian C. Jones

(57) ABSTRACT

In one embodiment, a flashing system is provided for fortifying seams between a first blast, ballistic, and forced entry resistant shelter module and a second blast, ballistic, and forced entry resistant shelter module. The system includes a first side flashing assembly for fortifying a first side seam between the first blast, ballistic, and forced entry resistant shelter module and the second blast, ballistic, and forced entry resistant shelter module, a top flashing assembly for fortifying a top seam between the first blast, ballistic, and forced entry resistant shelter module and the second blast, ballistic, and forced entry resistant shelter module, and a second side flashing assembly for fortifying a second side seam between the first blast, ballistic, and forced entry resistant shelter module and the second blast, ballistic, and forced entry resistant shelter module. The system can also include fastening assemblies for coupling the flashing assemblies with the blast, ballistic, and forced entry resistant shelter modules.

12 Claims, 12 Drawing Sheets

(56) References Cited

U.S. PATENT DOCUMENTS

| | | | | |
|---|---|---|---|---|
| 8,484,929 | B1 * | 7/2013 | Begdouri | E02D 29/045 52/745.03 |
| 8,596,018 | B2 * | 12/2013 | Dagher | F41H 5/013 52/222 |
| 9,702,138 | B1 * | 7/2017 | Rutherford | E04B 1/34853 |
| 10,443,260 | B2 * | 10/2019 | Roberts | F41H 5/24 |
| 2001/0037615 | A1 * | 11/2001 | Riech | E04H 9/14 52/79.1 |
| 2004/0206015 | A1 * | 10/2004 | Greenboim | E04H 9/10 52/79.1 |
| 2007/0180982 | A1 * | 8/2007 | Dagher | F41H 5/013 89/36.02 |
| 2009/0193730 | A1 * | 8/2009 | Pruet | E04H 9/14 52/222 |
| 2010/0089229 | A1 * | 4/2010 | Ackerman | F41H 5/013 89/36.04 |
| 2010/0162929 | A1 * | 7/2010 | Smit | E04B 1/3483 109/79 |
| 2011/0197746 | A1 * | 8/2011 | Melrose | E04H 9/10 89/36.02 |
| 2011/0232543 | A1 * | 9/2011 | Burroughs | E04H 9/06 109/79 |
| 2012/0180633 | A1 * | 7/2012 | Dagher | F41H 5/013 89/36.04 |
| 2013/0019742 | A1 * | 1/2013 | Lecarpentier | E04B 1/34321 89/36.02 |
| 2014/0290473 | A1 * | 10/2014 | Lorenzo | B32B 27/08 89/36.02 |
| 2016/0025461 | A1 * | 1/2016 | Roberts | B23K 31/02 296/187.07 |
| 2018/0010352 | A1 * | 1/2018 | Roberts | F41H 5/24 |
| 2018/0010353 | A1 * | 1/2018 | Roberts | B23P 6/00 |
| 2019/0368215 | A1 * | 12/2019 | Roberts | E06B 1/02 |

* cited by examiner

DETAIL CG 600
4"
6 5/8"
6 5/8"
630
3"
8 7/8"
18"
610
620
71 3/4"
605
5/8
5/8
18"
622
612
18"
CH
5/8
8 7/8"
640
6"
690

5/8"
17 1/4"
600
605
610
640
620
1/4"

1 1/4"
622
R 3/8"
2 1/8"
620

DETAIL CH
690
600
605
65 3/4"

5/8"
610
74 3/4"

DETAIL CJ

FLASHING SYSTEMS AND METHODS FOR MODULAR BLAST, BALLISTIC, AND FORCED ENTRY RESISTANT SHELTERS

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees.

BACKGROUND

Field of the Invention

The present invention relates to the field of armor and more specifically to flashing systems and methods for armored structures which comply with both ISO and State Department Standards.

Description of the Related Art

This section introduces aspects that may help facilitate a better understanding of the invention. Accordingly, the statements of this section are to be read in this light and are not to be understood as admissions about what is prior art or what is not prior art.

The U.S. Army Corps of Engineers (USACE) currently uses custom built International Standard Organization (ISO) containers as components for transportable shelters to protect troops from ballistics and explosives. This system is known in the art as a Hardened Alternative Trailer System (HATS), and can be categorized as a modular blast, ballistic, and forced entry resistant shelter.

The HATS structures typically must comply with the U.S. Department of State Certification Standard for Forced Entry and Ballistic Resistance of Structural Systems, SDSTD01.01, without exceeding stringent ISO weight and dimensional specifications. USACE has conducted considerable laboratory research to develop a HATS shelter which concurrently meets most standards. Aspects of exemplary HATS structures are discussed in U.S. patent publication numbers 2016/0025461, 2018/0010352, and 2018/0010353, the contents of which are incorporated herein by reference. These patent filings discuss, for example, specifications developed by the government to meet ISO Standard No. 668:2013 for twenty-foot structures. Hundreds of such structures have been fielded "in theater." In some cases, these structures are limited to no more than twenty feet in length, and no more than 8 feet wide or 8.6 feet high. The USACE has also conducted extensive research and testing to develop precise specifications for forty foot structures, as well as for considerably larger structures with much greater width and height than may be permitted under current ISO standards.

Although currently available modular blast, ballistic, and forced entry resistant protective shelters and other transportable trailer systems are well suited for use in protecting troops from forced entry, ballistics, and explosives, still further improvements are desirable. Embodiments of the present invention provide solutions to at least some of these outstanding needs.

SUMMARY

The present invention was developed to address the challenges associated with existing modular shelter systems, for example as described in the above Background section of this application. Research and development has led to a novel approach for improving the blast, ballistic, and forced entry resistance capabilities of such modular shelter systems.

The present invention advances the science of modular blast, ballistic, and forced entry resistant blast, ballistic, and forced entry resistant shelters. This disclosure describes a new flashing system intended to augment currently known modular blast, ballistic, and forced entry resistant shelter systems. Particular focus will be placed on the structure and function of the flashing systems and the use of flashing methods for improving the blast, ballistic, and forced entry resistant nature of modular shelter systems.

A modular blast, ballistic, and forced entry resistant shelter system incorporates multiple shelter modules. Typically, each module includes a top wall assembly, a base wall assembly, two side wall assemblies, and two end wall assemblies. Flashing systems and methods disclosed herein can provide hardened seams between wall assemblies of adjacent shelter modules when such modules are arranged in arrayed configurations.

BRIEF DESCRIPTION OF THE DRAWINGS

Embodiments of the invention will become more fully apparent from the following detailed description, the appended claims, and the accompanying drawings in which like reference numerals identify similar or identical elements.

DETAILED DESCRIPTION

Figure 1A:
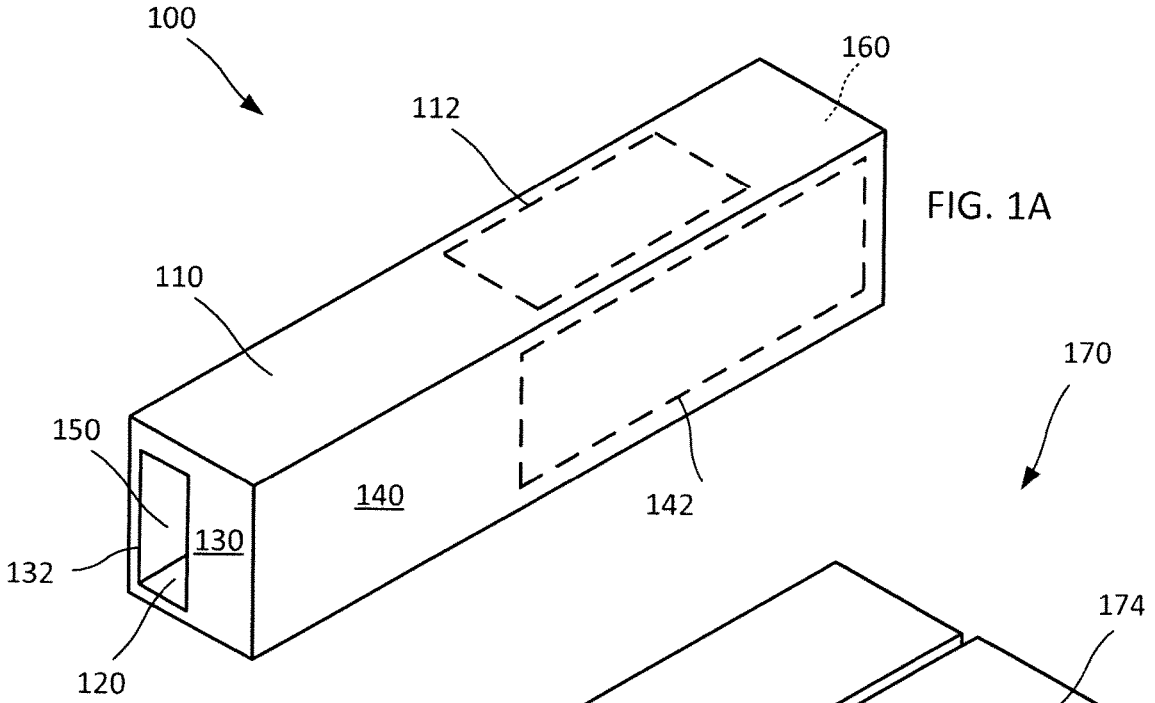
FIG. 1A depicts a blast, ballistic, and forced entry resistant shelter module according to certain embodiments of the present invention.

Detailed illustrative embodiments of the present invention are disclosed herein. However, specific structural and functional details disclosed herein are merely representative for purposes of describing example embodiments of the present invention. The present invention may be embodied in many alternate forms and should not be construed as limited to only the embodiments set forth herein. Further, the terminology used herein is for the purpose of describing particular embodiments only and is not intended to be limiting of example embodiments of the invention.

As used herein, the singular forms "a," "an," and "the," are intended to include the plural forms as well, unless the context clearly indicates otherwise. It further will be understood that the terms "comprises," "comprising," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

In at least one embodiment, the present invention aims to address potential shortcomings of existing modular shelter systems by providing an improved hardened seam between adjacent shelter modules.

Modular Shelter Systems

Embodiments of the present invention encompass flashing systems and methods for various blast, ballistic and forced entry protected structures, including Hardened Alternative Trailer Systems (HATS). In particular, certain embodiments described herein relate to flashing systems and methods for ISO containers having improved blast, ballistic, and forced entry properties as a result of its innovative and novel design and construction. The invention also relates to methods of using and producing such flashing systems.

Protective armor typically is designed for several applications types: personal protection such as helmets and vests, vehicle protection such as for high mobility multi-wheeled vehicles (HMMWVs), and rigid structures such as buildings. The protection of troops, for example, housed in containerized or modular housing units requires both blast and ballistic protection. Blast protection typically requires the material or structure to have the structural integrity to withstand the high loads of blast pressure. Ballistic protection typically requires the material or structure to stop the progress small arms rounds, bomb fragments, or other projectiles ranging in size from less than one millimeter to 10 mm or more and traveling at velocities in excess of 2000 meters per second for smaller fragments.

International Organization for Standardization (ISO) containers or modules are commonly used to house soldiers, disaster relief workers, contractors, and others where temporary and rapidly deployable shelters are used. Additionally, containers or modules are used for mobile medical units, command and control centers, communications, equipment storage, and the like. Many of these applications are located in areas exposed to threats such as car bombs, mortars, improvised explosive devices (IEDs), small arms fire, and the like. Containers or modules converted for these applications typically do not have systems for blast and fragmentation mitigation. Many of these applications are also exposed to the threat of forced entry.

Embodiments of the present invention provide improved designs for mitigating blast and ballistic threats, as well as forced entry. The flashing systems and methods disclosed herein are well suited for use with HATS containers and provide enhanced protection to blast, ballistic/projectile, and/or forced entry threats. In addition, these flashing systems and methods are well suited for deployment in remote and/or field fabrication locations or facilities where they are needed. The flashing systems and methods can also meet requirements for mitigating blast, ballistic, and forced entry threats such as those described in the U.S. Department of State Certification Standard for Forced Entry and Ballistic Resistance of Structural Systems, SD-STD-01.01, Revision G (amended) Apr. 30, 1993, the contents of which are incorporated herein by reference.

Figure 1B:
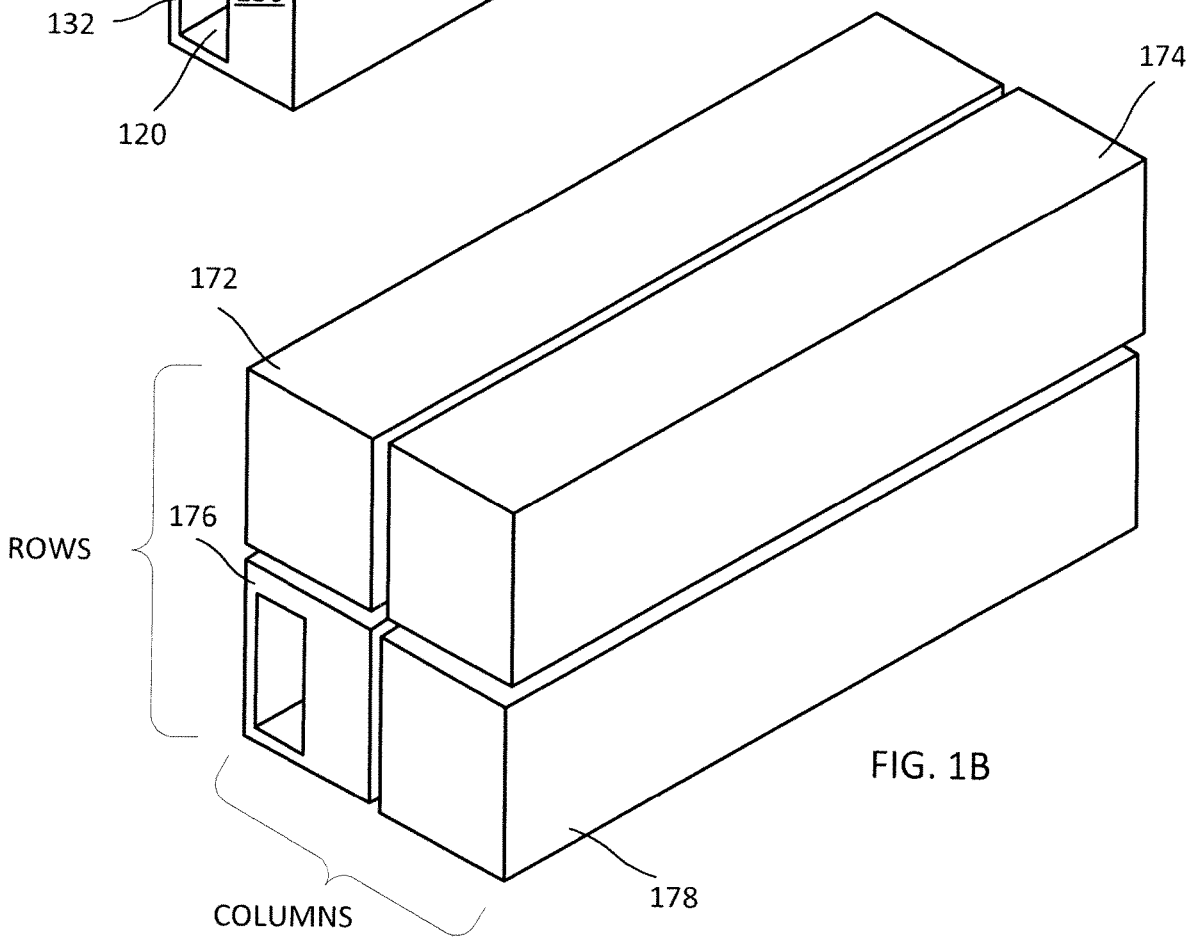
FIG. 1B depicts an array of blast, ballistic, and forced entry resistant shelter modules according to certain embodiments of the present invention.

Turning now to the drawings, FIG. 1A depicts an exemplary blast, ballistic, and forced entry resistant shelter module 100 according to embodiments of the present invention. Shelter module 100 includes a top wall assembly 110, a base wall assembly 120, a left side wall assembly 150, a right side wall assembly 140, a front wall assembly 130, and a rear wall assembly 160 (hidden from view) lies, and two end wall assemblies. Front wall assembly 130 includes a front door 132. As shown here, shelter module 100 can also include one or more passageways. For example, top wall assembly 110 may include a passageway 112 defined by an aperture, and right side wall assembly 140 may include a passageway 142 defined by an aperture. Relatedly, base wall assembly 120 and/or left side wall assembly 150 may include similar passageways. Multiple shelter modules can be arranged or assembled into arrayed or clustered configurations. For example, FIG. 1B depicts an array 170 of four shelter modules 172, 174, 176, and 178. Modules 172 and 174 constitute a top row of array 170, modules 176 and 178 constitute a bottom row of array 170, modules 172 and 176 constitute a left column of array 170, and modules 174 and 178 constitute a right column of array 170. When placed into such configurations, aligned passageways between two modules allow an occupant of the array or cluster to move from one module to another module, without traveling outside of the array or cluster. For example, bottom left module 176 can have a passageway in its top wall assembly, and top left module 172 can have a passageway in its bottom wall assembly, such that an occupant can travel between bottom left module 176 and top left module 172, via a staircase, ladder, or the like.

Figure 2:
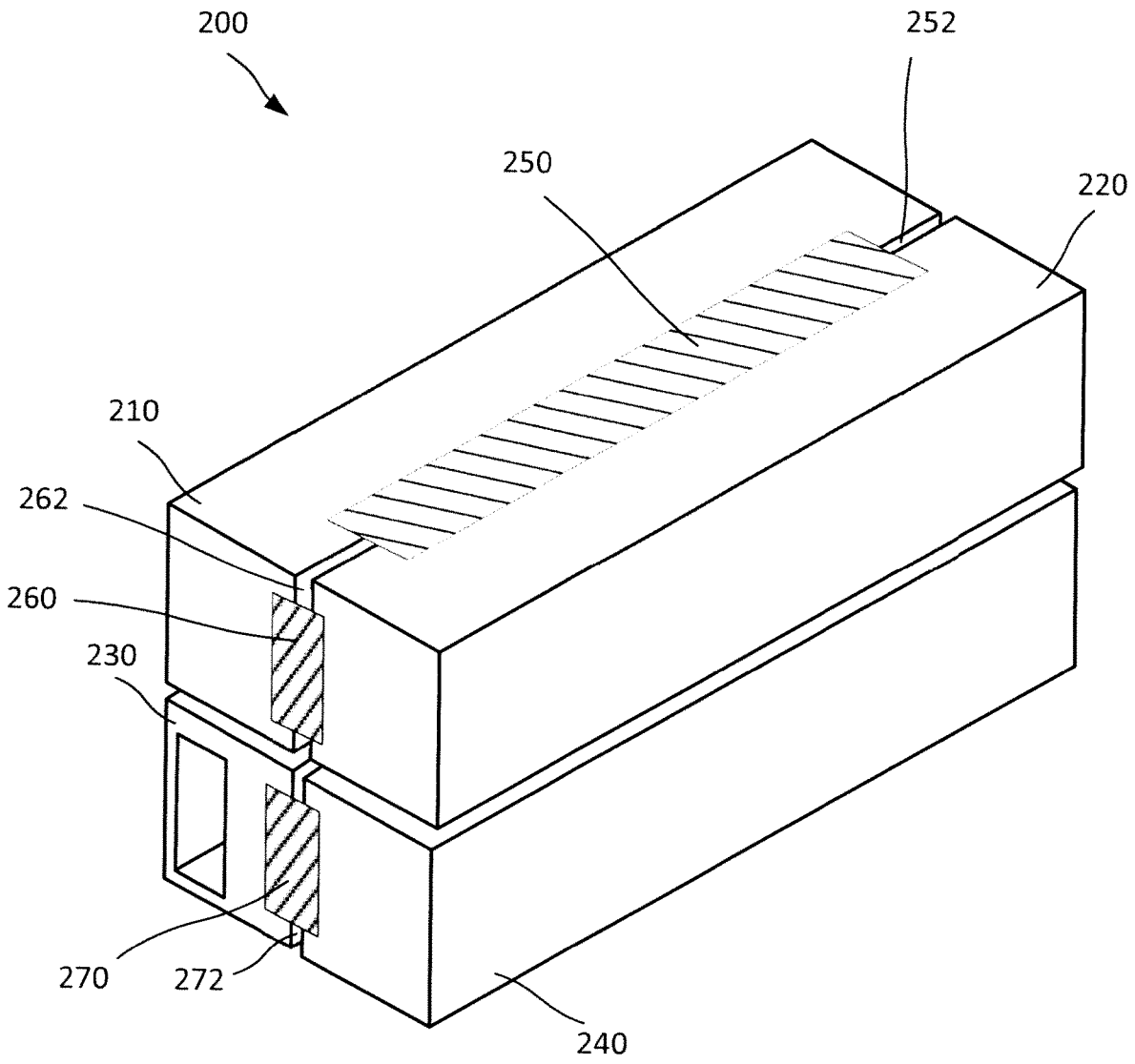
FIG. 2 depicts aspects of a fortified array of blast, ballistic, and forced entry resistant shelter modules according to certain embodiments of the present invention.

FIG. 2 depicts an array 200 of four shelter modules 210, 220, 230, and 240. The array also includes a top flashing assembly 250 that operates to fortify or harden a top seam 252 between modules 210 and 220, a front top flashing assembly 260 that operates to fortify or harden a front seam 262 between modules 210 and 220, and a front bottom flashing assembly 270 that operates to fortify or harden a front seam 272 between modules 230 and 240. In some embodiments, flashing assemblies include materials such as steel. As shown here, front flashing assemblies 260 and 270 are positioned in a vertical orientation, and top flashing assembly 250 is positioned in a horizontal orientation. The array 200 may also include a rear top flashing assembly (not shown) that fortifies a seam between modules 210 and 220, and a rear bottom flashing (not shown) that fortifies a seam between modules 230 and 240. The flashing assemblies can help to protect the modules by stopping or inhibiting rain or other moisture from penetrating the seams. The flashing assemblies can also serve as a structural connection between modules, and hold the modules together relative to one another, for example when a blast occurs near the modules. The flashing assemblies can prevent the modules from rebounding off one another after a blast event, and can prevent the modules from separating from one another after a blast event. As such, the flashing assemblies can provide the module arrays or clusters with an enhanced ability to withstand or resist nearby blast events, and to prevent bomb fragments or other projectiles from penetrating seams between the modules. Flashing assemblies can fortify module arrays against ballistic intrusions (e.g. small arms), blast events (e.g. vehicle-borne improvised explosive devices (VBIEDs)), and forced entries (e.g. mob attacks).

Figure 3:
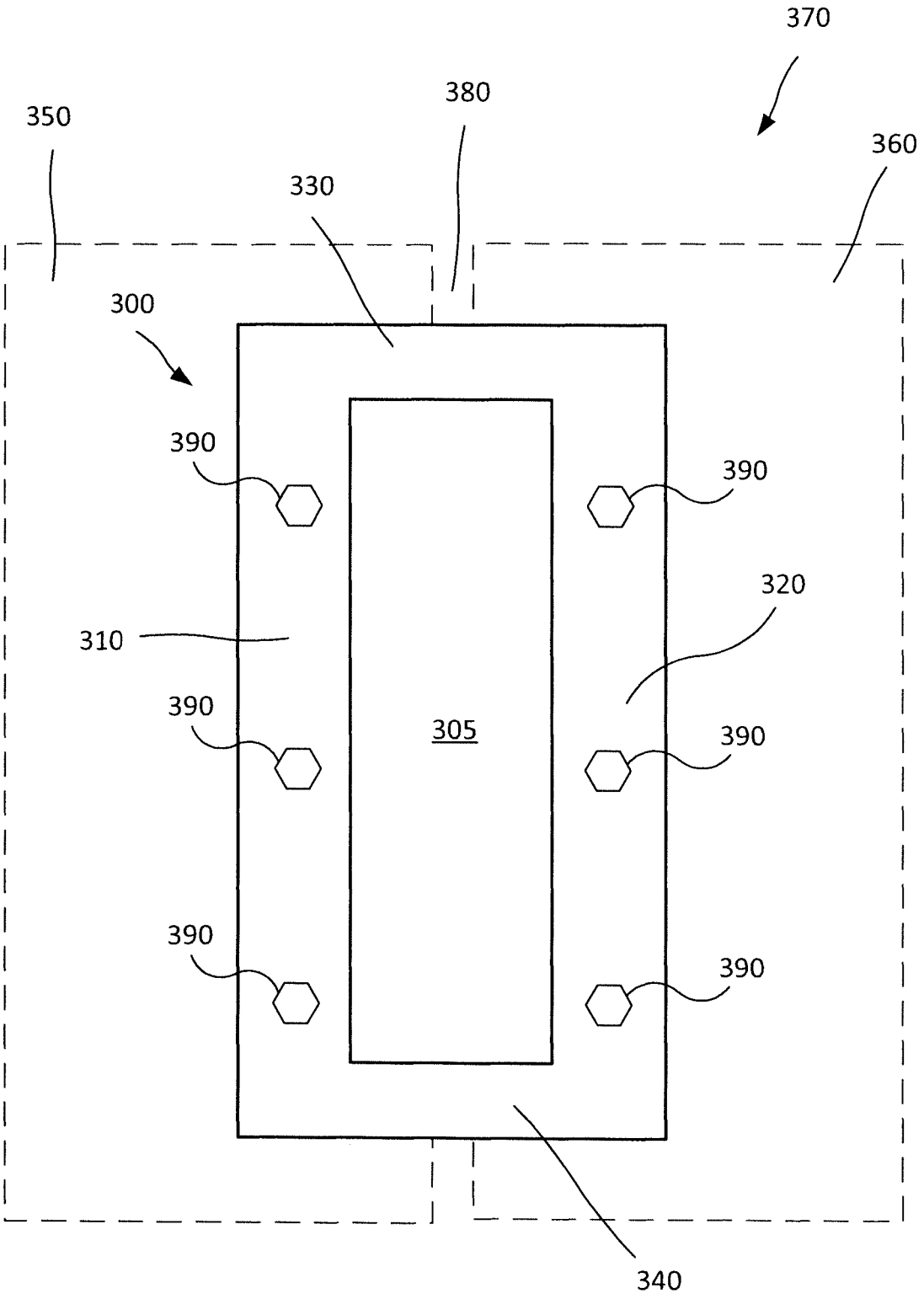
FIG. 3 depicts aspects of a flashing assembly according to certain embodiments of the present invention.

FIG. 3 depicts a flashing assembly 300 having a central section 305, a first side section 310, a second side section 320, a first end section 330, and a second end section 340. As shown here, flashing assembly 300 can be coupled with a first module 350 and a second module 360 of a module cluster 370. Flashing assembly 300 operates to fortify a seam 380 that is present between first module 350 and second module 360. Flashing assembly 300 can be fixed to first module 350 via one or more fastening mechanisms 390. Similarly, flashing assembly 300 can be fixed to second module via one or more fastening mechanisms 390.

Figure 4A:
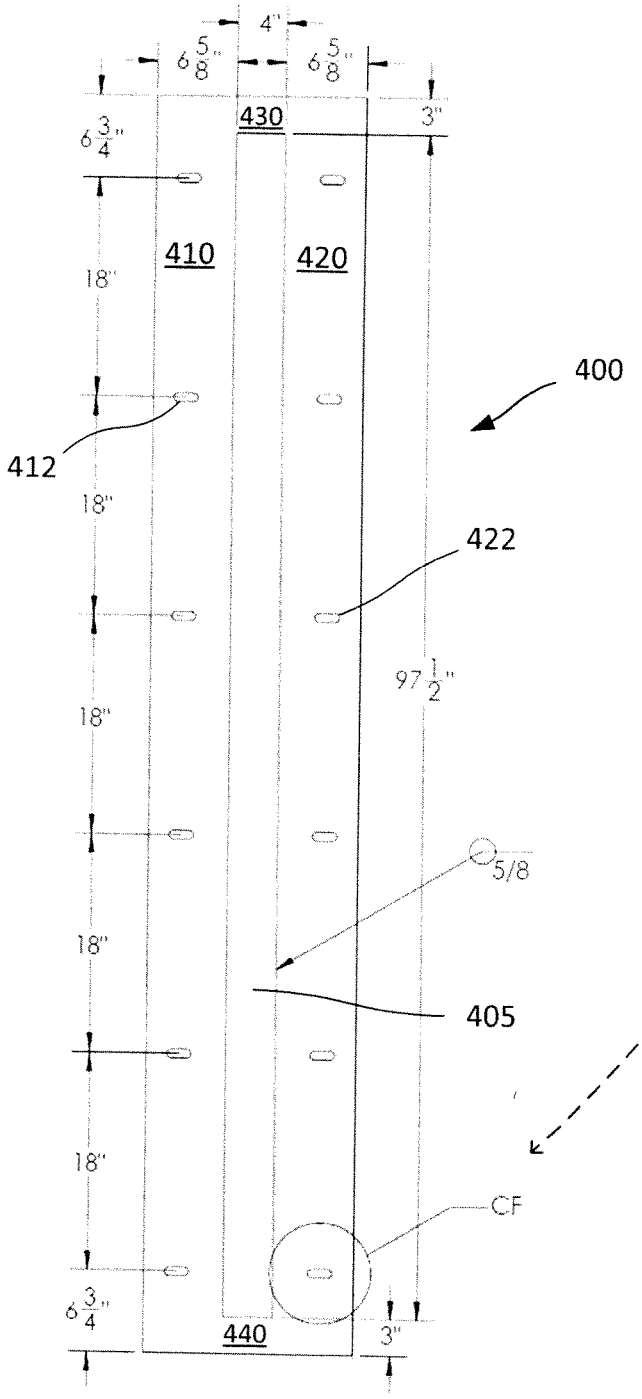
FIGS. 4A-4D depict aspects of a flashing assembly according to certain embodiments of the present invention.
Figure 4B:
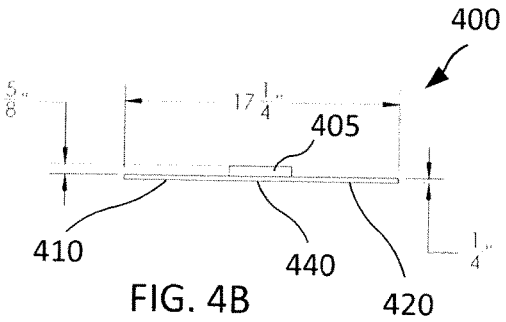
Figure 4C:
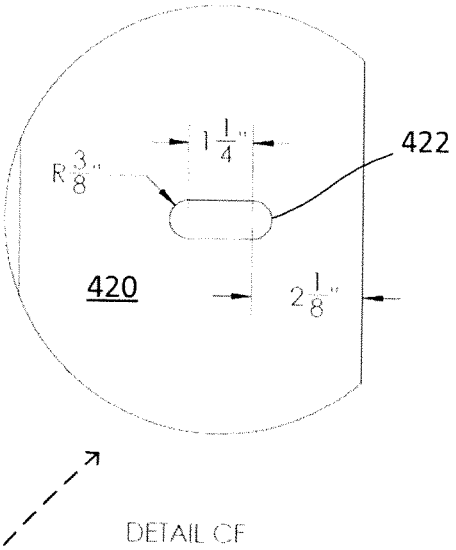

FIGS. 4A, 4B, and 4C depict different views of aspects of a flashing assembly 400 (e.g. side flashing, for vertical orientation). As shown in FIG. 4A, first side section 410 can include one or more apertures 412, and second side section 420 can include one or more apertures 422. In this embodiment, first side section 410 has six apertures and second side section 420 has six apertures. The apertures shown here are 18 inches apart at center, referring to the distance between the centers of the adjacent apertures. The end apertures are spaced 6¾ inches from the end of the side sections. The first and second side sections each have a width of 6⅝ inches and a length of 103½ inches. Central section 405 has a height of ⅝ inches. The first and second end sections 430, 440 each have a width of 4 inches and a length of 3 inches.

Figure 4D:
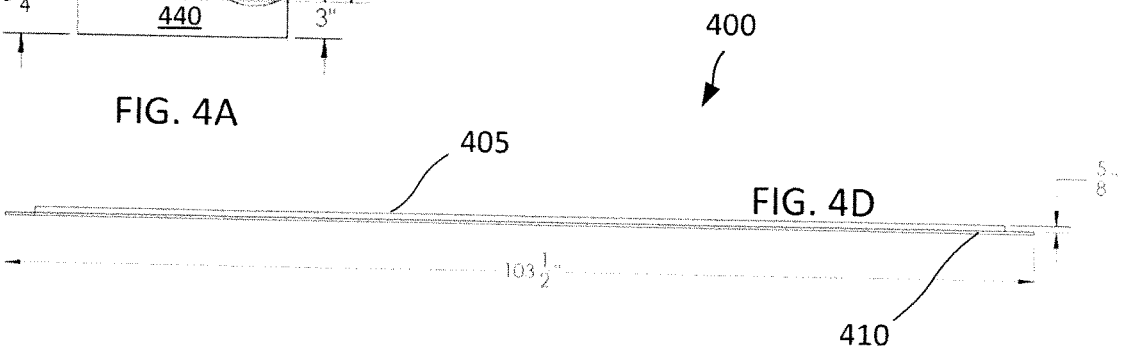

As shown in FIG. 4B, central section 405 has a height of ⅝ inches, and the side and end sections have a height of ¼ inches. As shown in the detail CF of FIG. 4C, aperture 422 can have an oval shape, with a width of 1¼ inches, and a radius of curvature of ⅜ inches. Aperture 422 can be located 2⅛ inches from the peripheral edge of second side section 420. The aperture can receive a bolt stud of a fastening mechanism, as discussed elsewhere herein (e.g. with respect to FIGS. 8A and 8B). As shown in FIG. 4D, the side sections (e.g. 410) can have a length of 103½ inches, and central section 405 can have a height of ⅝ inches. The dimension values depicted in FIGS. 4A-4D are only exemplary, and embodiments of the present invention encompass variations from these dimension values.

Figure 5A:
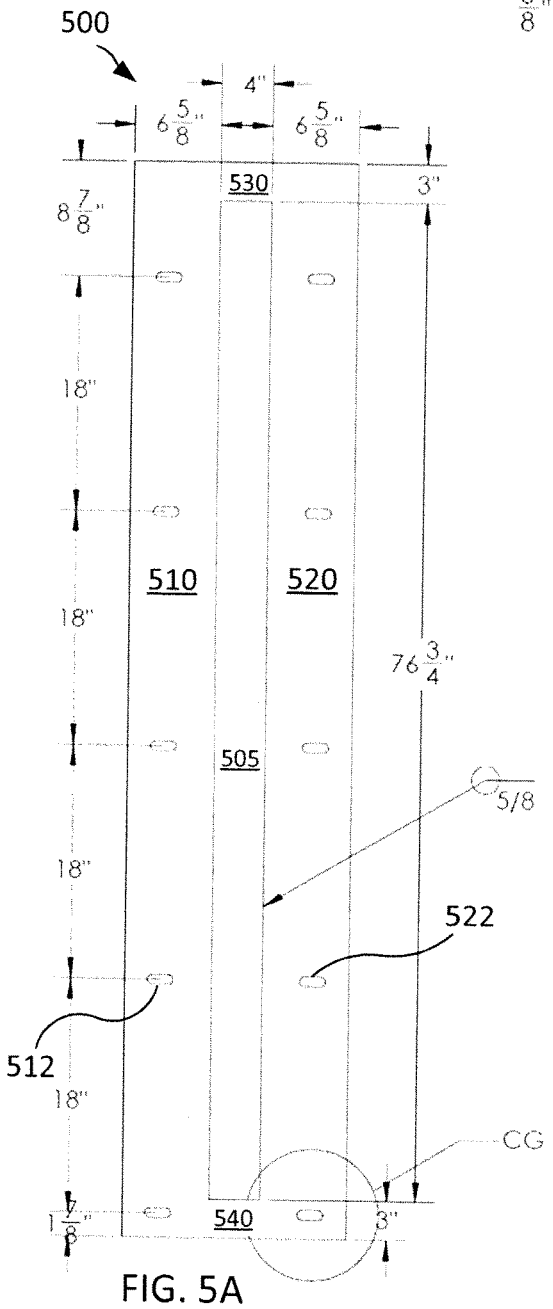
FIGS. 5A-5D depict aspects of a flashing assembly according to certain embodiments of the present invention.
Figure 5B:
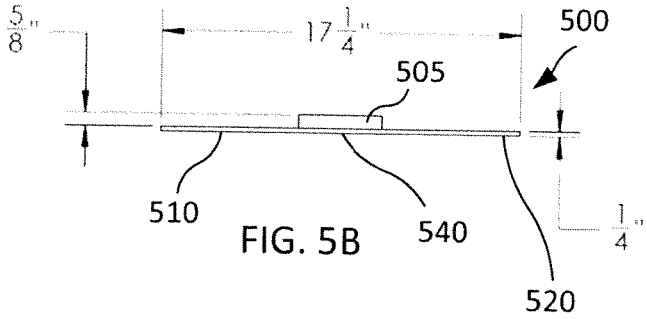
Figure 5C:
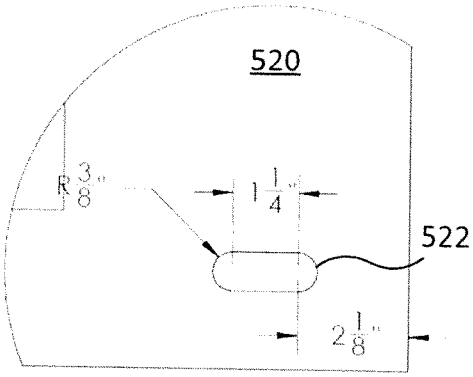

FIGS. 5A, 5B, and 5C depict different views of aspects of a flashing assembly 500 (e.g. a "roof flashing first" embodiment). As shown in FIG. 5A, first side section 510 can include one or more apertures 512, and second side section 520 can include one or more apertures 522. In this embodiment, first side section 510 has five apertures and second side section 520 has five apertures. The apertures shown here are 18 inches apart at center, referring to the distance between the centers of the adjacent apertures. The apertures near first end section 530 are spaced 8⅞ inches from the end of the side sections. The first and second side sections each have a width of 6⅝ inches and a length of 82¾ inches. Central section 505 has a height of ⅝ inches. The first and second end sections 530, 540 each have a width of 4 inches and a length of 3 inches.

Figure 5D:
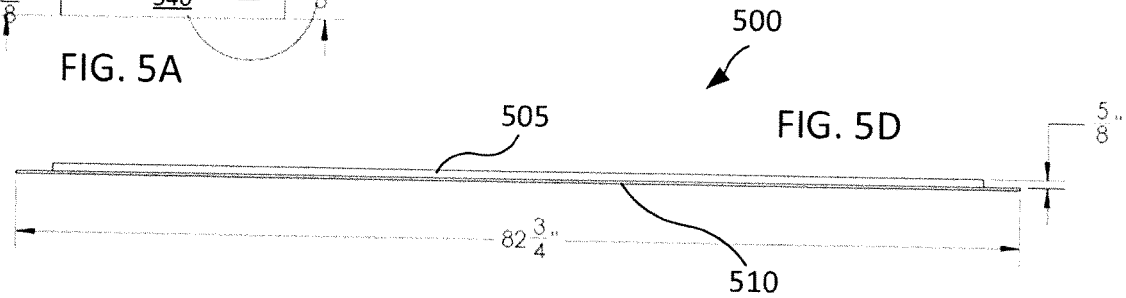

As shown in FIG. 5B, central section 505 has a height of ⅝ inches, and the side and end sections have a height of ¼ inches. As shown in the detail CG of FIG. 5C, aperture 522 can have an oval shape, with a width of 1¼ inches, and a radius of curvature of ⅜ inches. Aperture 522 can be located 2⅛ inches from the peripheral edge of second side section 520. The aperture can receive a bolt stud of a fastening mechanism, as discussed elsewhere herein (e.g. with respect to FIGS. 8A and 8B). As shown in FIG. 5D, the side sections (e.g. 510) can have a length of 82¾ inches, and central section 505 can have a height of ⅝ inches. The dimension values depicted in FIGS. 5A-5D are only exemplary, and embodiments of the present invention encompass variations from these dimension values.

Figures 6A, 6B, 6C, 6D:
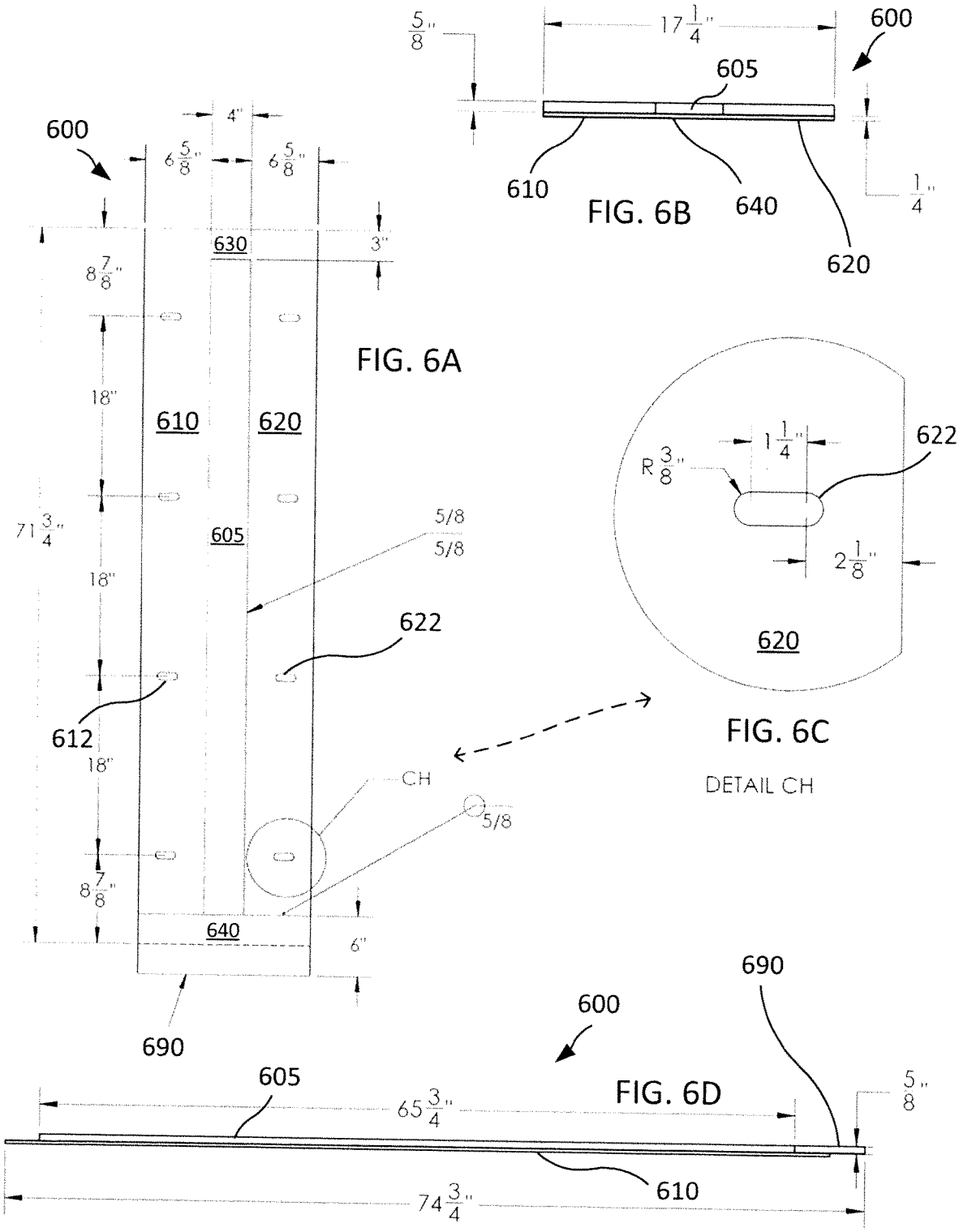
FIGS. 6A-6D depict aspects of a flashing assembly according to certain embodiments of the present invention.

FIGS. 6A, 6B, and 6C depict different views of aspects of a flashing assembly 600 (e.g. a "roof flashing middle" embodiment). As shown in FIG. 6A, first side section 610 can include one or more apertures 612, and second side section 620 can include one or more apertures 622. In this embodiment, first side section 610 has four apertures and second side section 620 has four apertures. The apertures shown here are 18 inches apart at center, referring to the distance between the centers of the adjacent apertures. The apertures near first end section 630 are spaced 8⅞ inches from the end of the side sections. The first and second side sections each have a width of 6⅝ inches and a length of 71¾ inches. Central section 605 has a height of ⅝ inches. The first and second end sections 630, 640 each have a width of 4 inches and a length of 3 inches. Flashing assembly 600 may also include or be coupled with a seam plate 690 (e.g. as further described in FIGS. 8A and 8B).

As shown in FIG. 6B, central section 605 has a height of ⅝ inches, and the side and end sections have a height of ¼ inches. As shown in the detail CH of FIG. 6C, aperture 622 can have an oval shape, with a width of 1¼ inches, and a radius of curvature of ⅜ inches. Aperture 622 can be located 2⅛ inches from the peripheral edge of second side section 620. The aperture can receive a bolt stud of a fastening mechanism, as discussed elsewhere herein (e.g. with respect to FIGS. 8A and 8B). As shown in FIG. 6D, the side sections (e.g. 610) can have a length of 82¾ inches, and central section 605 can have a height of ⅝ inches. The dimension values depicted in FIGS. 6A-6D are only exemplary, and embodiments of the present invention encompass variations from these dimension values.

Figure 7A:
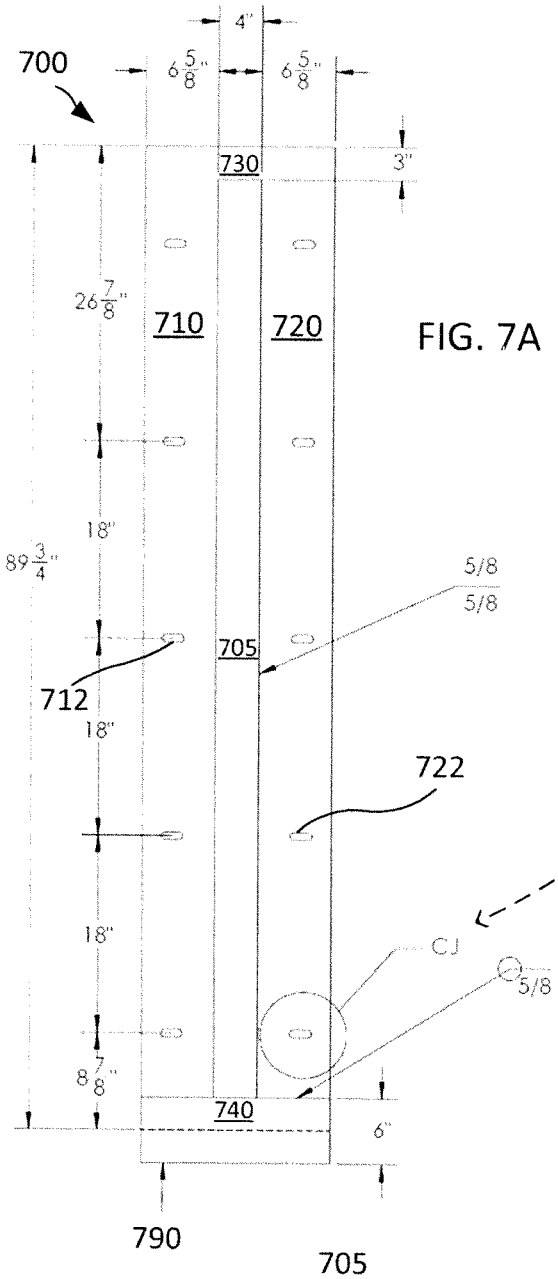
FIGS. 7A-7D depict aspects of a flashing assembly according to certain embodiments of the present invention.
Figure 7B:
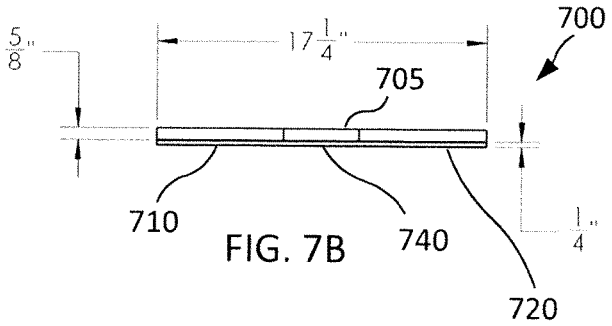
Figure 7C:
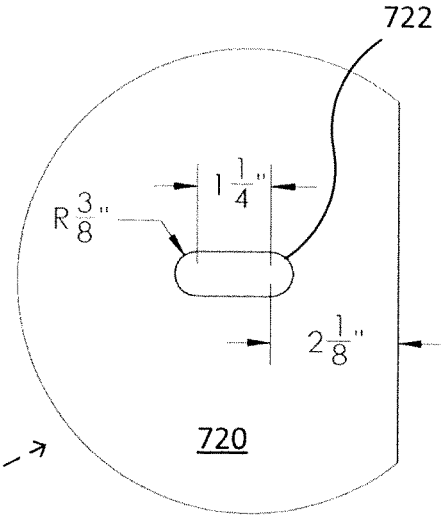

FIGS. 7A, 7B, and 7C depict different views of aspects of a flashing assembly 700 (e.g. a "roof flashing top last" embodiment). As shown in FIG. 7A, first side section 710 can include one or more apertures 712, and second side section 720 can include one or more apertures 722. In this embodiment, first side section 710 has five apertures and second side section 720 has five apertures. The apertures shown here are 18 inches apart at center, referring to the distance between the centers of the adjacent apertures. The apertures near first end section 730 are spaced 8⅞ inches from the end of the side sections. The first and second side sections each have a width of 6⅝ inches and a length of 89¾ inches. Central section 705 has a height of ⅝ inches. The first and second end sections 730, 740 each have a width of 4 inches and a length of 3 inches. Flashing assembly 700 may also include or be coupled with a seam plate 790 (e.g. as further described in FIGS. 8A and 8B).

Figure 7D:
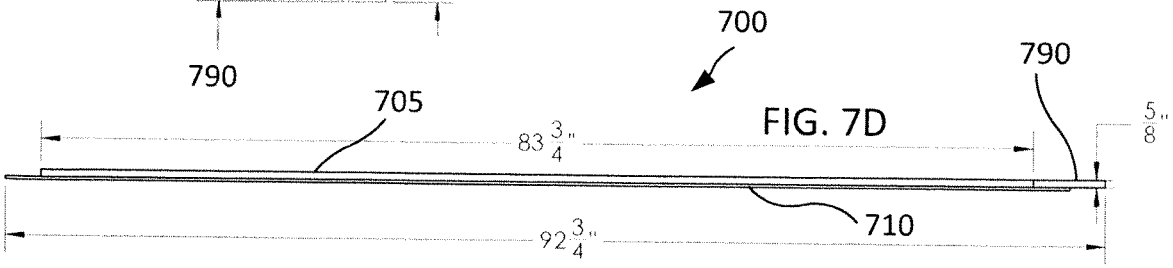

As shown in FIG. 7B, central section 705 has a height of ⅝ inches, and the side and end sections have a height of ¼ inches. As shown in the detail CJ of FIG. 7C, aperture 722 can have an oval shape, with a width of 1¼ inches, and a radius of curvature of ⅜ inches. Aperture 722 can be located 2⅛ inches from the peripheral edge of second side section 720. The aperture can receive a bolt stud of a fastening mechanism, as discussed elsewhere herein (e.g. with respect to FIGS. 8A and 8B). As shown in FIG. 7D, the side sections (e.g. 710) can have a length of 89¾ inches, and central section 705 can have a height of ⅝ inches. The dimension values depicted in FIGS. 6A-6D are only exemplary, and embodiments of the present invention encompass variations from these dimension values. Roof flashing first embodiments, middle embodiments, and top last embodiments (e.g. assemblies 500, 600, and 700) can operate in a coordinated fashion. For example, the first, middle, and top last roof flashings can be sequentially placed in order, in succession on the roof. When installing the flashing, one can lay the "first" roof flashing to begin. Next one can place a number of "middle" roof flashings to span the appropriate length depending on the length of the container, and then one can complete the roof flashing by placing the "last" roof flashing as the final piece in a succession of roof flashing. According to some embodiments, the flashing pieces are designed short in order to keep the weight down so that they could be two-man portable. This makes for easier installation.

Figure 8A:
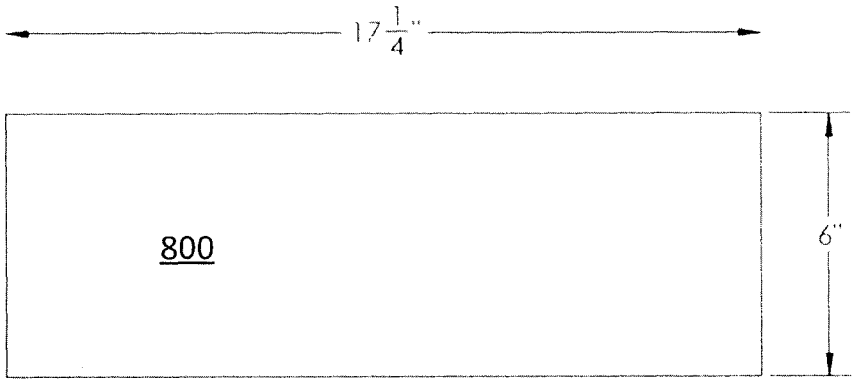
FIGS. 8A and 8B depict aspects of a top flashing seam plate according to certain embodiments of the present invention.
Figure 8B:
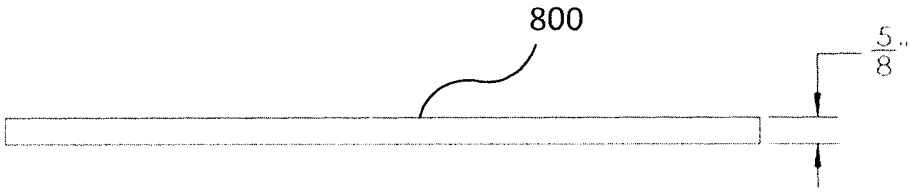
Figure 9:
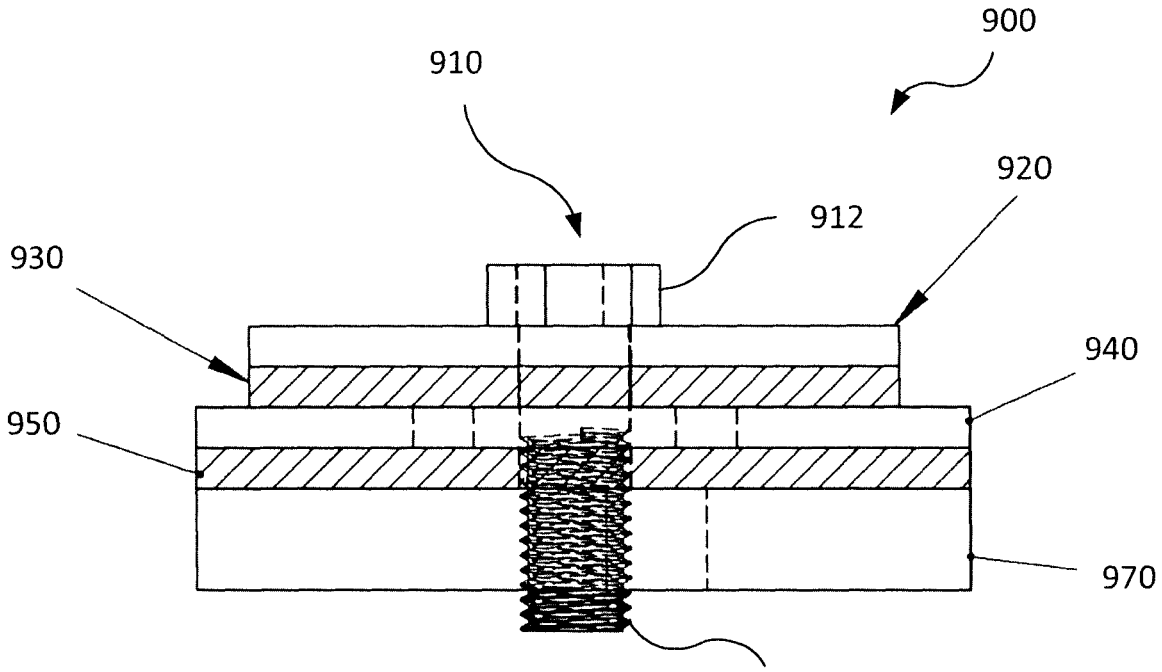
FIG. 9 depicts aspects of a fastening mechanism according to certain embodiments of the present invention.

FIGS. 8A and 8B depict aspects of a top flashing seam plate 800 according to embodiments of the present invention. As shown here, seam plate 800 has a height of ⅝ inches, a width of 17¼ inches, and a length of 6 inches. The dimension values depicted in FIGS. 8A-8B are only exemplary, and embodiments of the present invention encompass variations from these dimension values. As noted elsewhere herein, a flashing assembly can be fixed to module via one or more fastening mechanisms. FIG. 9 depicts aspects of a fastening mechanism 900 according to embodiments of the present invention. As shown here, fastening mechanism 900 can include a bolt 910 having a hexagonal head 912 and a threaded stud 914. Fastening mechanism 900 can also include a washer 920 (e.g. a 4 inch square washer), a first washer 930 (e.g. 4 inch square neoprene washer), and a second washer 950 (e.g. neoprene washer). As shown here, the washers 930, 950 can be positioned on opposing sides of a side section 940 of a flashing assembly, and washer 950 can be positioned between a side section 940 of a flashing assembly and an exterior plate 970 of a container module. According to some embodiments, exterior plate 970 has a thickness of ⅝ inches. In some embodiments, flashing assemblies are bolted to exterior plates of a container module, and not to structural members of a container module.

Figure 10A:
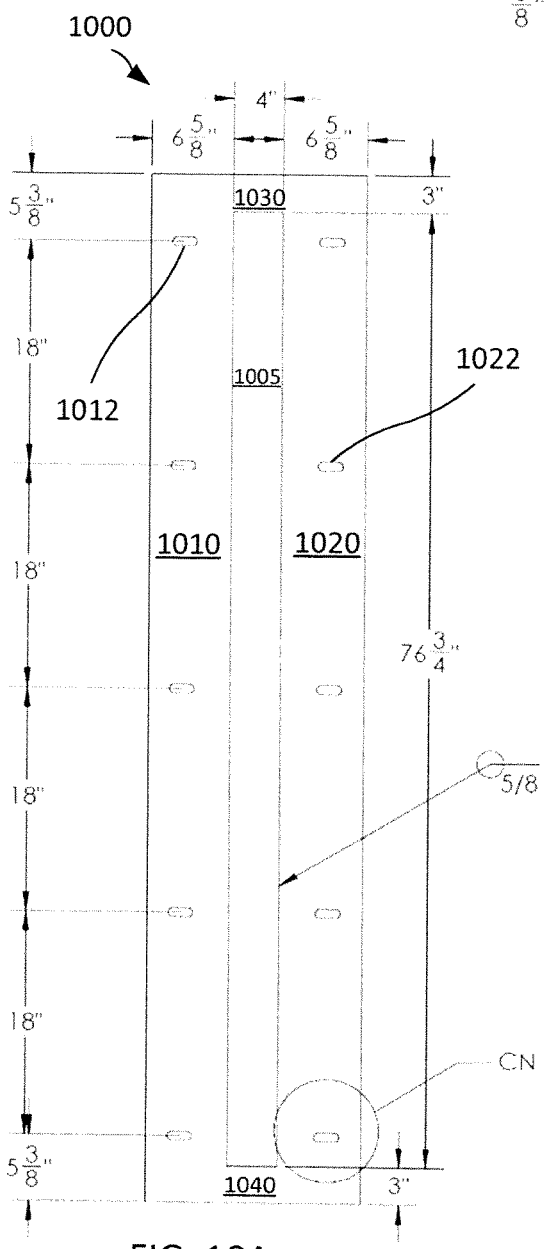
FIGS. 10A-10D depict aspects of a flashing assembly according to certain embodiments of the present invention.
Figure 10B:
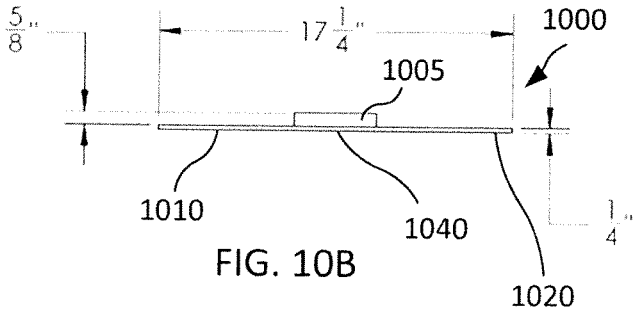
Figure 10C:
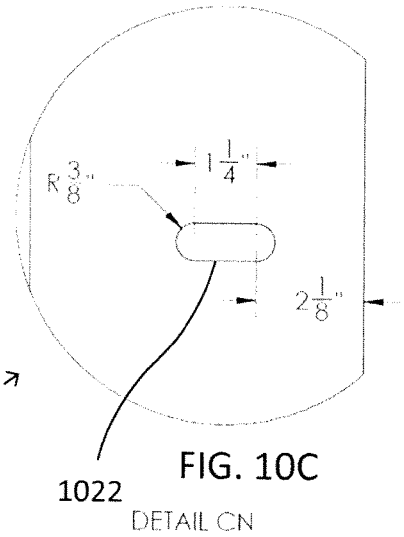

FIGS. 10A, 10B, and 10C depict different views of aspects of a flashing assembly 1000 (e.g. a "roof flashing top end to end" embodiment). As shown in FIG. 10A, first side section 1010 can include one or more apertures 1012, and second side section 1020 can include one or more apertures 1022. In this embodiment, first side section 1010 has five apertures and second side section 1020 has five apertures. The apertures shown here are 18 inches apart at center, referring to the distance between the centers of the adjacent apertures. The apertures near first end section 1030 are spaced 5⅜ inches from the end of the side sections. The first and second side sections each have a width of 6⅝ inches and a length of 82¾ inches. Central section 1005 has a height of ⅝ inches. The first and second end sections 1030, 1040 each have a width of 4 inches and a length of 3 inches.

Figure 10D:
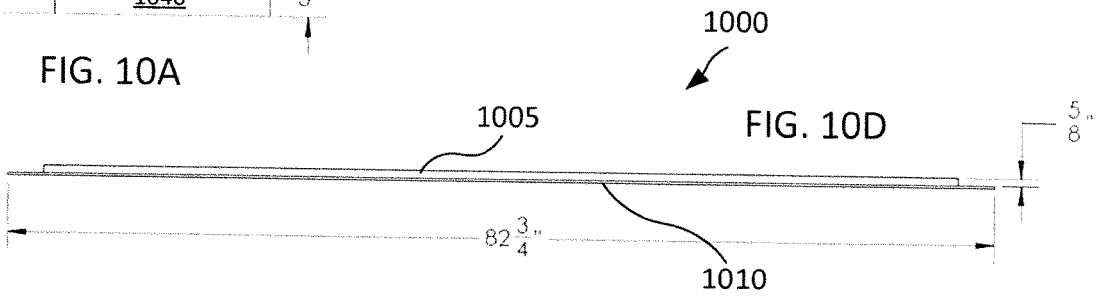

As shown in FIG. 10B, central section 1005 has a height of ⅝ inches, and the side and end sections have a height of ¼ inches. As shown in the detail CN of FIG. 10C, aperture 1022 can have an oval shape, with a width of 1¼ inches, and a radius of curvature of ⅜ inches. Aperture 1022 can be located 2⅛ inches from the peripheral edge of second side section 1020. The aperture can receive a bolt stud of a fastening mechanism, as discussed elsewhere herein (e.g. with respect to FIGS. 8A and 8B). As shown in FIG. 10D, the side sections (e.g. 1010) can have a length of 82¾ inches, and central section 1005 can have a height of ⅝ inches. The dimension values depicted in FIGS. 10A-10D are only exemplary, and embodiments of the present invention encompass variations from these dimension values.

Figure 11A:
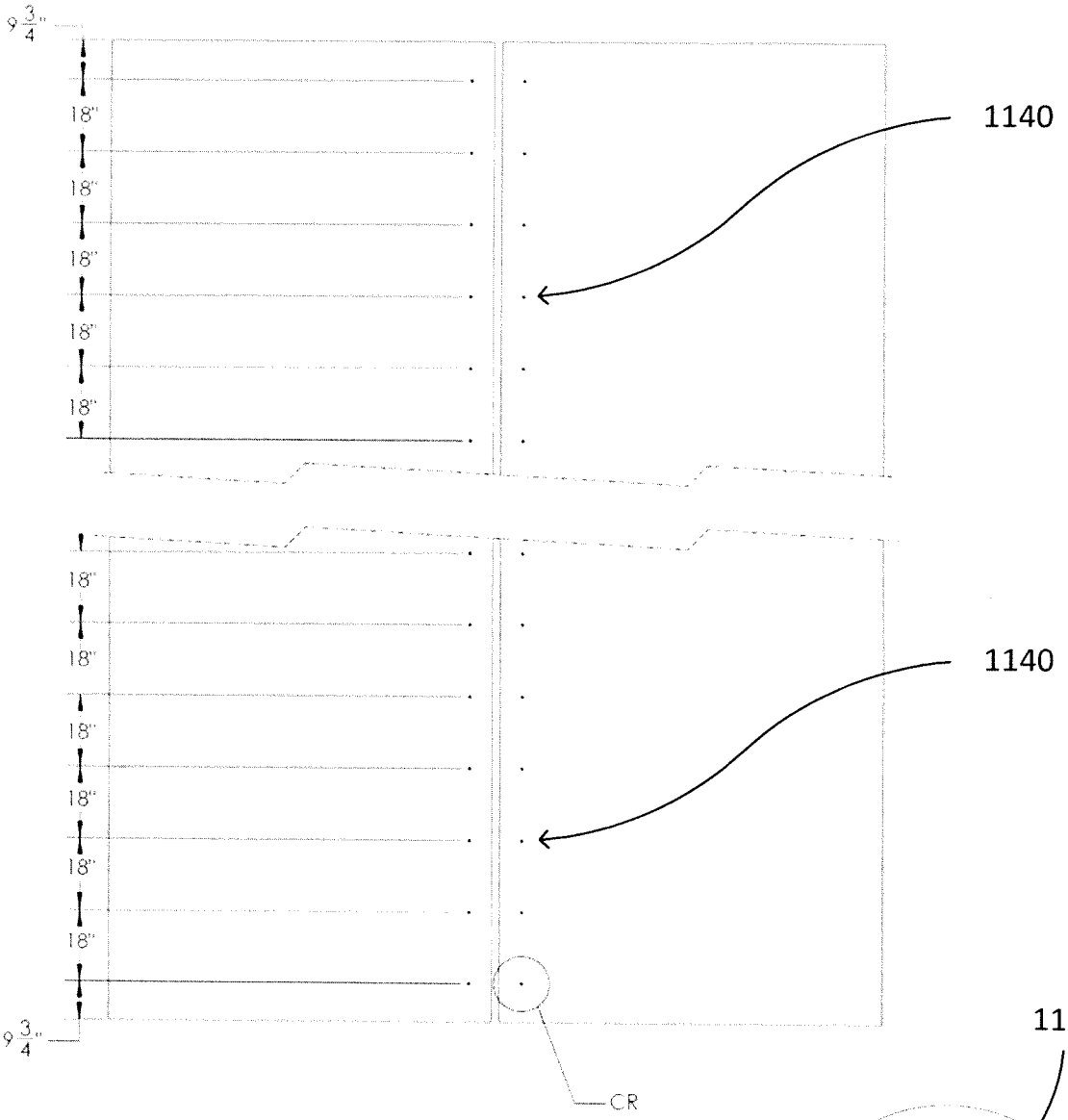
FIGS. 11A and 11B depict aspects of a fortified array of blast, ballistic, and forced entry resistant shelter modules according to certain embodiments of the present invention.
Figure 11B:
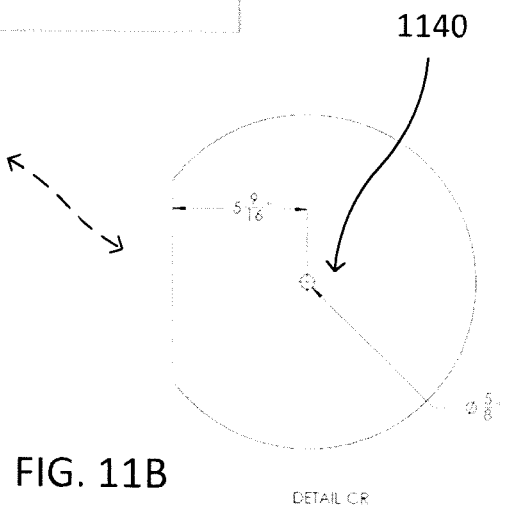

FIG. 11A depicts aspects of a "Roof Flashing Top Side to Side Detail" embodiment. As shown here, the HATS can include multiple apertures 1140. The apertures shown here are 18 inches apart at center, referring to the distance between the centers of the adjacent apertures. FIG. 11B provides a Detail CR which illustrates aspects of an aperture. As shown here, an aperture can have a diameter of ⅝ inch, and can be positioned 5⁹⁄₁₆ inches from an edge of the HATS.

Figure 12:
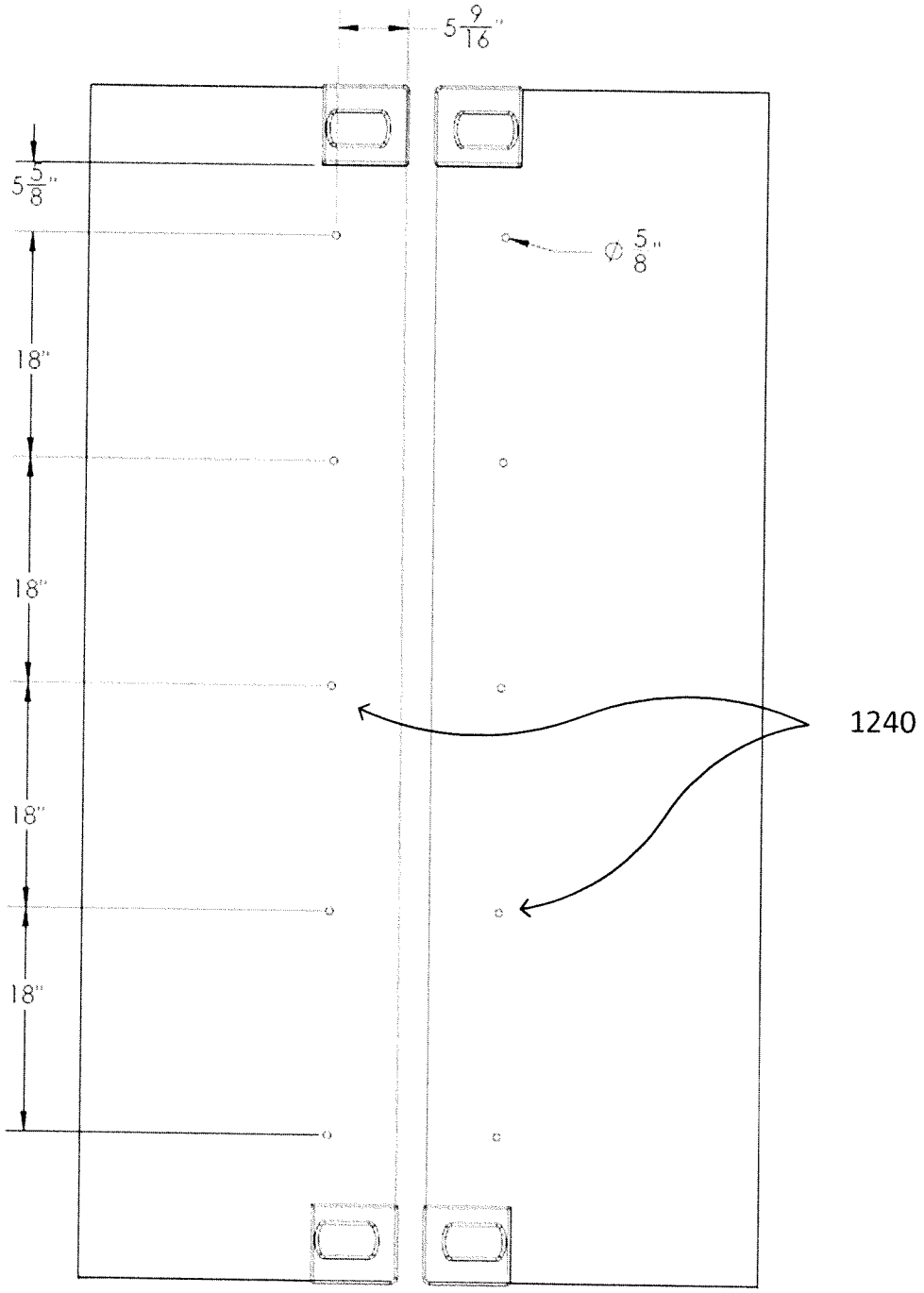
FIG. 12 depicts aspects of a fortified array of blast, ballistic, and forced entry resistant shelter modules according to certain embodiments of the present invention.

FIG. 12 depicts aspects of a "Roof Flashing Top End to End Detail" embodiment. As shown here, the HATS can include multiple apertures 1240. The apertures shown here are 18 inches apart at center, referring to the distance between the centers of the adjacent apertures. An aperture can have a diameter of ⅝ inch, and can be positioned 5⁹⁄₁₆ inches from an edge of the HATS. The roof flashing top "side to side" flashing refers to flashing that is placed in a vertical orientation to join the seams between two HATS units placed either side by side or end to end. The roof flashing "end to end" flashing is used for joining the seams at the roof of two HATS containers positioned end to end.

Figures 13A, 13B:
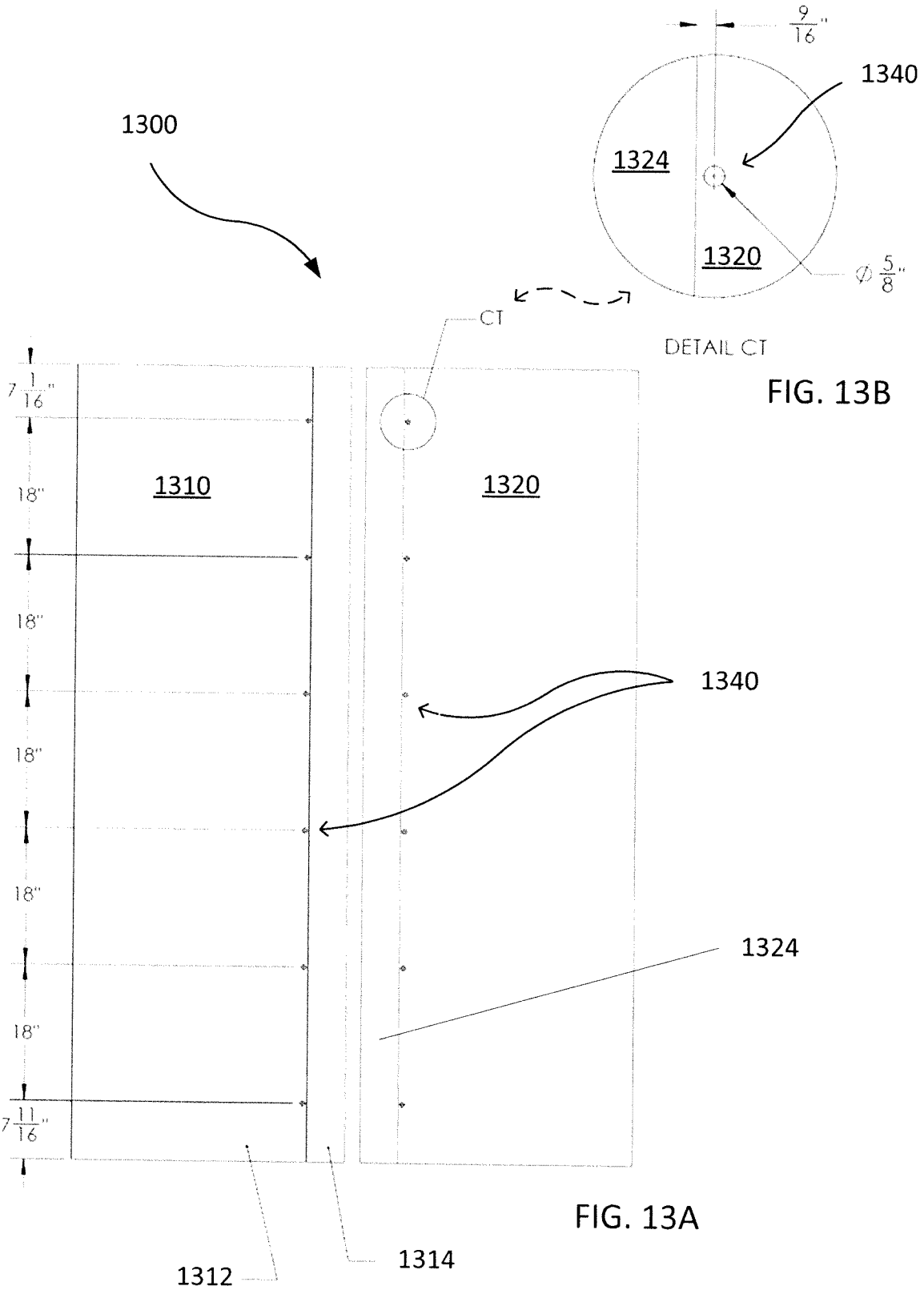
FIGS. 13A and 13B depict aspects of a fortified array of blast, ballistic, and forced entry resistant shelter modules according to certain embodiments of the present invention.

FIG. 13A depicts aspects of a module array according to embodiments of the present invention. In this side flashing end to end detail, it can be seen that a first module 1310 has multiple apertures 1340 and a second module 1320 has multiple apertures 1340. The apertures shown here are 18 inches apart at center, referring to the distance between the centers of the adjacent apertures. The modules can include sidewall exterior plates and corner columns. For example, as shown here, module 1310 includes a sidewall exterior plate 1312 and a 5 inch×5 inch corner column 1314. FIG. 13B provides a Detail CT which illustrates aspects of an aperture. As shown here, an aperture 1340 of second module 1320 can have a diameter of ⅝ inch, and can be positioned 5⁹⁄₁₆ inches from a corner column 1324.

SUMMARY

This application discloses the novel utility of flashing assemblies for modular blast, ballistic, and forced entry resistant shelters. Advantageously, the flashing assemblies provide enhanced connectivity, structural integrity, and blast performance for arrays or clusters of shelter modules.

In one aspect, embodiments of the present invention encompass flashing systems and methods for fortifying seams between adjacent blast, ballistic, and forced entry resistant shelter modules. An exemplary system can include a first side flashing assembly for fortifying a first side seam between the first blast, ballistic, and forced entry resistant shelter module and the second blast, ballistic, and forced entry resistant shelter module, a top flashing assembly for fortifying a top seam between the first blast, ballistic, and forced entry resistant shelter module and the second blast, ballistic, and forced entry resistant shelter module, a second side flashing assembly for fortifying a second side seam between the first blast, ballistic, and forced entry resistant shelter module and the second blast, ballistic, and forced entry resistant shelter module, a first side fastening assembly for coupling the first flashing assembly with the first blast, ballistic, and forced entry resistant shelter module and the second blast, ballistic, and forced entry resistant shelter module, a top side fastening assembly for coupling the second flashing assembly with the first blast, ballistic, and forced entry resistant shelter module and the second blast, ballistic, and forced entry resistant shelter module, and a second side fastening assembly for coupling the second flashing assembly with the first blast, ballistic, and forced entry resistant shelter module and the second blast, ballistic, and forced entry resistant shelter module. In some cases, the first side flashing assembly includes a first side section, a second side section, a first end section, and a second end section, where the first side section includes an aperture and the second side section includes an aperture, and where the first side fastening assembly includes a first side fastening mechanism for coupling the first side section of the first side flashing assembly with the first blast, ballistic, and forced entry resistant shelter module and a second side fastening mechanism for coupling the second side section of the first side flashing assembly with the second blast, ballistic, and forced entry resistant shelter module. In some cases, the first side fastening mechanism includes a threaded bolt, a first washer, and a second washer. In some cases, the first side fastening mechanism includes a threaded bolt, a first washer, and a second washer.

In some cases, the top side flashing assembly includes a first side section, a second side section, a first end section, and a second end section, where the first side section includes an aperture and the second side section includes an aperture, and where the top fastening assembly includes a first side fastening mechanism for coupling the first side section of the top side flashing assembly with the first blast, ballistic, and forced entry resistant shelter module and a second side fastening mechanism for coupling the second side section of the top side flashing assembly with the second blast, ballistic, and forced entry resistant shelter module. In some cases, the first side fastening mechanism includes a threaded bolt, a first washer, and a second washer. In some cases, the first side fastening mechanism includes a threaded bolt, a first washer, and a second washer. In some cases, the second side flashing assembly includes a first side section, a second side section, a first end section, and a second end section, where the first side section includes an aperture and the second side section includes an aperture, and where the second side fastening assembly includes a first side fastening mechanism for coupling the first side section of the second side flashing assembly with the first blast, ballistic, and forced entry resistant shelter module and a second side fastening mechanism for coupling the second side section of the second side flashing assembly with the second blast, ballistic, and forced entry resistant shelter module. In some cases, the first side fastening mechanism includes a threaded bolt, a first washer, and a second washer. In some cases, the first side fastening mechanism includes a threaded bolt, a first washer, and a second washer. In some cases, the first side flashing assembly is a front side flashing assembly and the second side flashing assembly is a rear side flashing assembly.

In another aspect, embodiments of the present invention encompass methods for fortifying seams between a first blast, ballistic, and forced entry resistant shelter module and a second blast, ballistic, and forced entry resistant shelter module. Exemplary methods include fortifying a first side seam between the first blast, ballistic, and forced entry resistant shelter module and the second blast, ballistic, and forced entry resistant shelter module with a first side flashing assembly, fortifying a top seam between the first blast, ballistic, and forced entry resistant shelter module and the second blast, ballistic, and forced entry resistant shelter module with a top side flashing assembly, and fortifying a second side seam between the first blast, ballistic, and forced entry resistant shelter module and the second blast, ballistic, and forced entry resistant shelter module with a second side flashing assembly. In some cases, the step of fortifying the first side seam includes coupling the first side flashing assembly with the first blast, ballistic, and forced entry resistant module and the second blast, ballistic, and forced entry resistant module using a first side fastening assembly. In some cases, the step of fortifying the first side seam includes coupling a first side section of the first side flashing assembly with the first blast, ballistic, and forced entry resistant module using a first fastening mechanism, and coupling a second side section of the first side flashing assembly with the second blast, ballistic, and forced entry resistant module using a second fastening mechanism. In some cases, the step of fortifying the top side seam includes coupling the top side flashing assembly with the first blast, ballistic, and forced entry resistant module and the second blast, ballistic, and forced entry resistant module using a top side fastening assembly. In some cases, the step of fortifying the top side seam includes coupling a first side section of the top side flashing assembly with the first blast, ballistic, and forced entry resistant module using a first fastening mechanism, and coupling a second side section of the top side flashing assembly with the second blast, ballistic, and forced entry resistant module using a second fastening mechanism. In some cases, the step of fortifying the second side seam includes coupling the second side flashing assembly with the first blast, ballistic, and forced entry resistant module and the second blast, ballistic, and forced entry resistant module using a second side fastening assembly. In some cases, the step of fortifying the second side seam includes coupling a first side section of the second side flashing assembly with the first blast, ballistic, and forced entry resistant module using a first fastening mechanism, and coupling a second side section of the second side flashing assembly with the second blast, ballistic, and forced entry resistant module using a second fastening mechanism. In some cases, the first side flashing assembly is a front side flashing assembly and the second side flashing assembly is a rear side flashing assembly.

In still another aspect, embodiments of the present invention encompass a fortified array of blast, ballistic, and forced entry resistant modules. An exemplary array can include a first blast, ballistic, and forced entry resistant shelter module, a second blast, ballistic, and forced entry resistant shelter module, a first side flashing assembly spanning a first side seam between the first blast, ballistic, and forced entry resistant shelter module and the second blast, ballistic, and forced entry resistant shelter module, a top flashing assembly spanning a top seam between the first blast, ballistic, and forced entry resistant shelter module and the second blast, ballistic, and forced entry resistant shelter module, a second side flashing assembly spanning a second side seam between the first blast, ballistic, and forced entry resistant shelter module and the second blast, ballistic, and forced entry resistant shelter module, a first side fastening assembly coupling the first flashing assembly with the first blast, ballistic, and forced entry resistant shelter module and the second blast, ballistic, and forced entry resistant shelter module, a top side fastening assembly coupling the second flashing assembly with the first blast, ballistic, and forced entry resistant shelter module and the second blast, ballistic, and forced entry resistant shelter module, and a second side fastening assembly coupling the second flashing assembly with the first blast, ballistic, and forced entry resistant shelter module and the second blast, ballistic, and forced entry resistant shelter module. In some cases, the first side flashing assembly is a front side flashing assembly and the second side flashing assembly is a rear side flashing assembly.

As will be appreciated by one of ordinary skill in the art, the present invention may be embodied as an apparatus (including, for example, a system, a machine, a device, and/or the like), as a method (including, for example, a business process, and/or the like), or as any combination of the foregoing.

Embodiments of the invention can be manifest in the form of methods and apparatuses for practicing those methods.

Unless explicitly stated otherwise, each numerical value and range should be interpreted as being approximate as if the word "about" or "approximately" preceded the value or range.

Unless otherwise indicated, all numbers expressing quantities of ingredients, properties such as molecular weight, percent, ratio, reaction conditions, and so forth used in the specification and claims are to be understood as being modified in all instances by the term "about," whether or not the term "about" is present. Accordingly, unless indicated to the contrary, the numerical parameters set forth in the specification and claims are approximations that may vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements.

It will be further understood that various changes in the details, materials, and arrangements of the parts which have been described and illustrated in order to explain embodiments of this invention may be made by those skilled in the art without departing from embodiments of the invention encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the invention.

Although the elements in the following method claims, if any, are recited in a particular sequence with corresponding labeling, unless the claim recitations otherwise imply a particular sequence for implementing some or all of those elements, those elements are not necessarily intended to be limited to being implemented in that particular sequence.

All documents mentioned herein are hereby incorporated by reference in their entirety or alternatively to provide the disclosure for which they were specifically relied upon.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

What is claimed is:

1. A flashing system for fortifying seams located between a first blast, ballistic, and forced entry resistant shelter module and a second blast, ballistic, and forced entry resistant shelter module, the system comprising:

a first side flashing assembly configured to fortify a first side seam located between the first blast ballistic, and forced entry resistant shelter module and the second blast, ballistic, and forced entry resistant shelter module, the first side flashing assembly spanning a substantial portion of the first side seam;

a top flashing assembly configured to fortify a top seam located between the first blast ballistic, and forced entry resistant shelter module and the second blast, ballistic, and forced entry resistant shelter module, the top flashing assembly spanning a substantial portion of the top seam;

a second side flashing assembly configured to fortify a second side seam located between the first blast, ballistic, and forced entry resistant shelter module and the second blast ballistic, and forced entry resistant shelter module, the second side flashing assembly spanning a substantial portion of the second side seam;

a first side fastening assembly configured to couple the first side flashing assembly to each of the first blast, ballistic, and forced entry resistant shelter module and the second blast ballistic, and forced entry resistant shelter module;

a top side fastening assembly configured to couple the top flashing assembly to each of the first blast, ballistic, and forced entry resistant shelter module and the second blast, ballistic, and forced entry resistant shelter module; and a second side fastening assembly configured to couple the second side flashing assembly to each of the first blast, ballistic, and forced entry resistant shelter module and the second blast, ballistic, and forced entry resistant shelter module, wherein the first side flashing assembly comprises a first side section, a second side section, a first end section, and a second end section, wherein the first side section comprises a first side aperture and the second side section comprises a second side aperture, and wherein the first side fastening assembly comprises a first side fastening mechanism configured to couple the first side section of the first side flashing assembly with the first blast, ballistic, and forced entry resistant shelter module and a second side fastening mechanism configured to couple the second side section of the first side flashing assembly with the second blast, ballistic, and forced entry resistant shelter module.

2. The system of claim 1, wherein the first side flashing assembly is a front side flashing assembly and the second side flashing assembly is a rear side flashing assembly.

3. The assembly of claim 1, wherein each of the first side fastening mechanism and the second side fastening mechanism comprises a threaded bolt, a first washer, and a second washer.

4. The flashing system of claim 1 which meets requirements for mitigating blast, ballistic, and forced entry threats set forth in the U.S. Department of State Certification Standard SD-STD-01.01, Revision G (amended) Apr. 30, 1993.

5. The system of claim 1, wherein the second side flashing assembly comprises a first side section, a second side section, a first end section, and a second end section, wherein the first side section comprises a first side aperture and the second side section comprises a second side aperture, and wherein the second side fastening assembly comprises a first side fastening mechanism configured to couple the first side section of the second side flashing assembly with the first blast, ballistic, and forced entry resistant shelter module and a second side fastening mechanism configured to couple the second side section of the second side flashing assembly with the second blast, ballistic, and forced entry resistant shelter module.

6. The assembly of claim 5, wherein each of the first side fastening mechanism and the second side fastening mechanism comprises a threaded bolt, a first washer, and a second washer.

7. The system of claim 1, wherein the top flashing assembly comprises a first side section, a second side section, a first end section, and a second end section, wherein the first side section comprises a first side aperture and the second side section comprises a second side aperture, and wherein the top side fastening assembly comprises a first side fastening mechanism configured to couple the first side section of the top flashing assembly with the first blast, ballistic, and forced entry resistant shelter module and a second side fastening mechanism configured to couple the second side section of the top flashing assembly with the second blast, ballistic, and forced entry resistant shelter module.

8. The assembly of claim 7, wherein the first side fastening mechanism comprises a threaded bolt, a first washer, and a second washer.

9. The assembly of claim 8, wherein the second side fastening mechanism comprises a threaded bolt, a first washer, and a second washer.

10. A fortified array of blast, ballistic, and forced entry resistant modules, the array comprising:

a first blast, ballistic, and forced entry resistant shelter module;

a second blast, ballistic, and forced entry resistant shelter module;

a first side flashing assembly spanning a substantial portion of a first side seam located between the first blast, ballistic, and forced entry resistant shelter module and the second blast, ballistic, and forced entry resistant shelter module;

a top flashing assembly spanning a substantial portion of a top seam located between the first blast, ballistic, and forced entry resistant shelter module and the second blast, ballistic, and forced entry resistant shelter module;

a second side flashing assembly spanning a substantial portion of a second side seam located between the first blast, ballistic, and forced entry resistant shelter module and the second blast, ballistic, and forced entry resistant shelter module;

a first side fastening assembly coupling the first side flashing assembly to each of the first blast, ballistic, and forced entry resistant shelter module and the second blast, ballistic, and forced entry resistant shelter module;

a top side fastening assembly coupling the top flashing assembly to each of the first blast, ballistic, and forced entry resistant shelter module and the second blast, ballistic, and forced entry resistant shelter module; and a second side fastening assembly coupling the second side flashing assembly to each of the first blast, ballistic, and forced entry resistant shelter module and the second blast, ballistic, and forced entry resistant shelter module.

11. The array of claim 10, wherein the first side flashing assembly is a front side flashing assembly and the second side flashing assembly is a rear side flashing assembly.

12. The fortified array of claim 10 wherein said flashing assemblies meet requirements for mitigating blast, ballistic, and forced entry threats set forth in the U.S. Department of State Certification Standard SD-STD-01.01, Revision G (amended) Apr. 30, 1993.

* * * * *